United States Patent [19]

Dombrowski et al.

[11] 4,131,868

[45] Dec. 26, 1978

[54] INCANDESCENT LAMP SOCKET HAVING OVERTEMPERATURE PROTECTOR

[75] Inventors: Joseph A. Dombrowski, Manchester; Clement T. Baxter, Beverly, both of Mass.; Frederick B. Howard, Cape Elizabeth; George H. Simpson, Westbrook, both of Me.

[73] Assignee: GTE Sylvania Incorporated, Danvers, Mass.

[21] Appl. No.: 774,825

[22] Filed: Mar. 7, 1977

[51] Int. Cl.[2] ..... H01H 61/01

[52] U.S. Cl. ..... 337/113; 337/381

[58] Field of Search ..... 361/105; 339/30; 337/84, 88, 92, 112, 113, 381

[56] References Cited

U.S. PATENT DOCUMENTS

| | | | |
|---|---|---|---|
| 1,683,992 | 9/1928 | Shoenberg et al. | 337/113 X |
| 1,733,743 | 10/1929 | Ludwig | 337/85 |
| 2,458,724 | 1/1949 | Parassi et al. | 337/113 X |

*Primary Examiner*—George Harris
*Attorney, Agent, or Firm*—James Theodosopoulos

[57] ABSTRACT

A socket for an electric lamp contains a thermal protector to shut off current flow to the lamp when the socket is heated above a predetermined temperature.

5 Claims, 3 Drawing Figures

INCANDESCENT LAMP SOCKET HAVING OVERTEMPERATURE PROTECTOR

THE INVENTION

This invention concerns sockets for incandescent lamps and is particularly concerned with means for preventing overheating of such sockets. Such overheating could result from improper installation or from use of wrong wattage lamps.

The type of protection afforded by this invention differs from the overload protective devices that are now in general use. Such devices are generally located remote from lamp sockets and comprise, for example, fuses or circuit breakers which trip when there is excess current in the circuit.

In this invention the thermal protector is constructed as part of the socket itself and is so connected as to interrupt current flow to the socket when the thermal protector is heated to a predetermined temperature.

Figure 1:
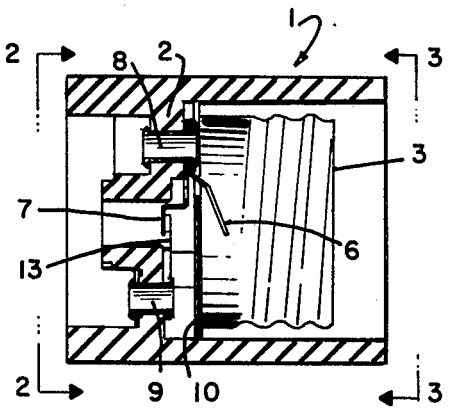
FIG. 1 is a sectional view of a socket in accordance with this invention.
Figure 2:
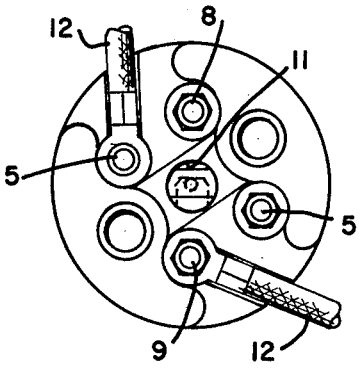
FIGS. 2 and 3 are respective end views thereof.
Figure 3:
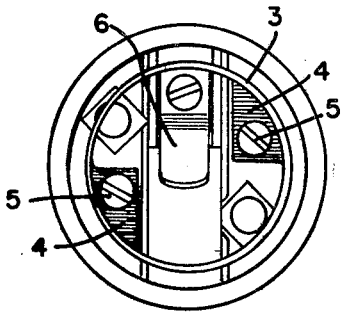

In one embodiment of a socket in accordance with this invention, as shown in the drawing, the socket comprises a generally cylindrical socket housing 1 made of an insulative material, say, high temperature plastic. Housing 1 has a several tiered shelf 2 therein which serves as the support for the various socket elements. Disposed within housing 1 is a threaded metal shell 3 having two generally flat projections 4 at the bottom thereof which are fastened to shelf 2 by screws or rivets extending through projection 4 and shelf 2.

Also disposed in housing 1 is a spring metal strip 6 positioned to make contact with the center contact of an incandescent lamp base when it is screwed into shell 3. The end of strip 6 is in contact with a metal strap 7 and both are secured to shelf 2 by a screw or rivet 8 therethrough.

In disengageable contact with metal strap 7 is a snap acting bimetallic blade 13 which is secured to shelf 2 by a screw or rivet 9 extending therethrough. At a predetermined temperature, blade 13 snaps away from, and breaks contact with, strap 7. Disposed between blade 13 and metal strip 6 is a flat insulator 10 to prevent blade 13 from touching strip 6 when it snaps open.

Electrical power is supplied to the socket by means of lead-in wires 12, one of which is connected to a screw 5 and the other to screw 9.

In operation, an incandescent lamp having, say, a medium screw base, is screwed into metal shell 3 until the center contact of the lamp base contacts spring metal strip 6. The circuit path from one of the lead-in wires to the outer rim of the lamp base is from screw 5 to projection 4 of shell 3. The circuit path from the other lead-in wire to the center contact of the lamp base is from screw 9 to bimetal blade 13, metal strap 7 and spring metal strip 6. In normal operation, bimetal blade 13 will not be heated to its snapping temperature of, say, 150° C., and operation will not be interrupted. But if there is an improper installation, say, use of a 200 watt lamp in a socket rated for 100 watts maximum, bimetal blade 13 will be heated above its snapping temperature and will open the circuit. Upon cooling, bimetal blade 13 will close and recomplete the circuit. But if the oversized lamp has not been replaced, bimetal blade 13 will continue to open as it is heated above its snapping temperature.

Another thermal sensitive element that may be used in place of snap acting bimetal blade 13 is a cantilever bimetal blade which opens gradually instead of snapping open.

Extending through shelf 2 is a calibration hole 11 which provides access to metal strap 7 and/or bimetal blade 13. The opening temperature may be increased or decreased, if necessary, by inserting a thin instrument through calibration hole 11 and slightly bending contact strap 7 toward or away from bimetal blade 13.

We claim:

1. A socket for an electric lamp comprising an insulative housing containing a threaded metal shell for screwing a lamp base thereinto, a spring metal contact within said housing for making contact with the center contact of the lamp base, means for supplying electric current to said threaded metal shell and said spring metal contact, and a thermal protector within said housing to interrupt the electric current when the socket becomes heated above a predetermined temperature, wherein said thermal protector is normally closed at the normal operating temperature of the socket but opens at a predetermined higher temperature.

2. The socket of claim 1 wherein said thermal protector comprises a bimetal blade.

3. The socket of claim 2 including an insulator between the bimetal blade and the spring metal contact to prevent said blade from touching said spring metal contact when said blade opens.

4. The socket of claim 2 wherein said housing has a shelf therewithin to which is fastened a metal strap that is electrically disposed between the spring metal contact and the bimetal blade.

5. The socket of claim 4 wherein said shelf has a calibration hole therethrough by means of which the opening temperature of the bimetal blade may be adjusted.

* * * * *

Dedication 4,131,868.—*Joseph A. Dombrowski*, Manchester; *Clement T. Baxter*, Beverly, Mass.; *Frederick B. Howard*, Cape Elizabeth and *George H. Simpson*, Westbrook, Me. INCANDESCENT LAMP SOCKET HAVING OVER-TEMPERATURE PROTECTOR. Patent dated Dec. 26, 1978. Dedication filed June 23, 1980, by the assignee, *GTE Products Corporation.*

Hereby dedicates to the Public the remaining term of said patent.

[*Official Gazette November 25, 1980.*]